US008434827B2

(12) United States Patent
Young et al.

(10) Patent No.: US 8,434,827 B2
(45) Date of Patent: May 7, 2013

(54) INFANT SUPPORT STRUCTURE WITH POLYMER COATED RESTRAINT STRAPS

(75) Inventors: Gregory S. Young, Lancaster, NY (US); John S. Canna, Orchard Park, NY (US); Juliette Marlene Welch, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 188 days.

(21) Appl. No.: 12/843,349

(22) Filed: Jul. 26, 2010

(65) Prior Publication Data

US 2012/0019034 A1 Jan. 26, 2012

(51) Int. Cl.
*A47D 1/10* (2006.01)
*A47D 15/00* (2006.01)
*B60R 22/10* (2006.01)

(52) U.S. Cl.
USPC ..... 297/467; 297/464; 297/468; 297/484; 297/250.1; 297/256.16

(58) Field of Classification Search .. 297/250.1–256.17, 297/464–488
See application file for complete search history.

(56) References Cited

U.S. PATENT DOCUMENTS

| | | | | |
|---|---|---|---|---|
| 1,376,625 | A | 5/1921 | Johnston | |
| 2,449,741 | A | 9/1948 | Fitzpatrick | |
| 3,136,581 | A | 6/1964 | Caballero | |
| 3,604,751 | A * | 9/1971 | Caigan | 297/440.12 |
| 3,713,692 | A | 1/1973 | McCracken et al. | |
| 4,164,357 | A * | 8/1979 | Conachey | 297/256.1 |
| 4,298,648 | A * | 11/1981 | Turnbull | 297/468 X |
| 4,583,253 | A * | 4/1986 | Hall | 297/250.1 X |
| 4,690,859 | A * | 9/1987 | Porter et al. | 297/DIG. 5 X |
| 4,712,258 | A | 12/1987 | Eves | |
| 4,746,565 | A * | 5/1988 | Bafford et al. | 297/DIG. 5 X |
| 4,858,997 | A | 8/1989 | Shubin | |
| 5,082,325 | A | 1/1992 | Sedlack | |
| 5,096,760 | A * | 3/1992 | Thary | 297/452.1 X |
| 5,099,532 | A * | 3/1992 | Thomas et al. | 5/484 |
| 5,267,680 | A * | 12/1993 | Torok | 297/256.13 X |
| 5,399,423 | A * | 3/1995 | McCullough et al. | 297/452.16 X |
| 5,407,739 | A * | 4/1995 | McCullough et al. | 297/452.16 X |
| 5,435,272 | A | 7/1995 | Epstein | |
| 5,492,662 | A * | 2/1996 | Kargol et al. | 297/452.48 X |
| 5,499,860 | A * | 3/1996 | Smith et al. | 297/255 |
| 5,501,216 | A | 3/1996 | Byrd | |
| 5,637,389 | A * | 6/1997 | Colvin et al. | 297/DIG. 1 X |
| 5,641,200 | A * | 6/1997 | Howell | 297/256.17 |
| 5,704,690 | A * | 1/1998 | Schwartz | 297/451.9 |
| 5,803,540 | A * | 9/1998 | Schwartz | 297/239 |
| 5,830,811 | A * | 11/1998 | Tang et al. | 297/471 X |
| 5,845,970 | A * | 12/1998 | Schwartz | 297/451.9 |
| 5,855,415 | A * | 1/1999 | Lilley, Jr. | 297/452.27 |
| 5,927,235 | A | 7/1999 | Olaiz | |
| 6,022,075 | A * | 2/2000 | Blocker et al. | 297/251 |

(Continued)

FOREIGN PATENT DOCUMENTS

GB 2367738 A 4/2002

*Primary Examiner* — Rodney B White
(74) *Attorney, Agent, or Firm* — Edell, Shapiro & Finnan, LLC

(57) ABSTRACT

An infant support structure includes a support frame, a seat portion coupled to the support frame and configured for receiving an infant in a seated position, and a restraint assembly. The restraint assembly is coupled to the seat portion and configured to retain the infant in the seat portion. The restraint assembly includes a strap portion having a polymer coating.

16 Claims, 8 Drawing Sheets

U.S. PATENT DOCUMENTS 6,057,252 A * 5/2000 Tang et al. ..... 297/471 X
6,071,835 A * 6/2000 Tang et al. ..... 297/471 X
6,155,638 A * 12/2000 Bapst ..... 297/250.1
6,179,382 B1 * 1/2001 Schwartz ..... 297/239
6,189,970 B1 2/2001 Rosko
6,409,272 B1 6/2002 Martin et al.
6,450,576 B1 * 9/2002 Rhein et al. ..... 297/250.1
6,533,322 B2 * 3/2003 Janz ..... 280/808
6,592,179 B1 * 7/2003 Miyazaki ..... 297/146
6,637,825 B2 * 10/2003 Janz ..... 297/468
6,702,327 B2 * 3/2004 Janz ..... 297/483 X
6,726,287 B1 * 4/2004 Janz ..... 297/483
6,769,146 B2 * 8/2004 Copeland et al. .... 297/452.61 X
6,811,222 B1 11/2004 Sumner
7,175,235 B2 * 2/2007 Schwartz ..... 297/452.64
7,201,452 B1 * 4/2007 Franks ..... 297/253 X
7,331,629 B2 2/2008 Knaven
7,350,862 B2 * 4/2008 Fransen et al. ..... 297/250.1
7,469,965 B2 12/2008 Glover et al.
7,472,961 B2 * 1/2009 Schwartz et al. ..... 297/451.9
7,476,630 B2 * 1/2009 Schwartz et al. .... 297/452.64 X
D586,049 S 2/2009 Boardman
7,506,929 B2 * 3/2009 Fransen et al. ..... 297/250.1
7,578,561 B2 8/2009 Canna et al.
7,658,446 B2 * 2/2010 Meeker et al. ..... 297/250.1
7,819,485 B2 * 10/2010 Hartenstine et al. ... 297/250.1 X
7,823,979 B2 * 11/2010 Schwartz et al. ..... 297/451.9
7,901,003 B2 * 3/2011 Meeker et al. ..... 297/250.1
7,997,658 B2 * 8/2011 DeLellis et al. ..... 297/484
8,124,684 B2 * 2/2012 Spaan et al. ..... 297/468 X
2002/0011749 A1 * 1/2002 Janz ..... 297/482
2003/0047972 A1 * 3/2003 Burleigh et al. ..... 297/250.1 X
2003/0094845 A1 * 5/2003 Janz ..... 297/468
2004/0084952 A1 * 5/2004 Janz ..... 297/483
2005/0110318 A1 * 5/2005 Meeker et al. ..... 297/256.16
2005/0168026 A1 * 8/2005 Kau ..... 297/256.16
2005/0194825 A1 * 9/2005 Kurz et al. ..... 297/219.1
2005/0206213 A1 * 9/2005 Schwartz ..... 297/452.64
2007/0228788 A1 * 10/2007 Meeker et al. ..... 297/250.1
2008/0054691 A1 * 3/2008 Glover ..... 297/250.1
2008/0111410 A1 5/2008 Santamaria
2008/0150335 A1 * 6/2008 Pines et al. ..... 297/219.12
2008/0164735 A1 * 7/2008 Hartenstine et al. ..... 297/250.1
2008/0296944 A1 * 12/2008 Nakagawa et al. ..... 297/250.1
2010/0140997 A1 * 6/2010 Biaud et al. ..... 297/250.1
2011/0095581 A1 * 4/2011 Pierce ..... 297/219.1

* cited by examiner

INFANT SUPPORT STRUCTURE WITH POLYMER COATED RESTRAINT STRAPS

FIELD OF THE INVENTION

The present invention relates to an infant support structure including a restraint assembly, and in particular a restraint assembly including polymer coated straps or webbing.

BACKGROUND OF THE INVENTION

Conventional infant support structures provide support for a child or infant. Some examples of such child or infant support structures include, but are not limited to, bouncers, swings, infant seats and high chairs. Some such support structures include a seating area and restraint straps configured for retaining an infant in the seating area, such as during feeding and other seated activities.

Feeding an infant or young child is often a very messy process. Both the child and child accessible portions of the support structure often become covered with food and liquid. In particular, most highchairs include a restraint system. A conventional restraint system generally includes restraint straps and some sort of fastening mechanism for fastening the restraint straps to together. In addition, the conventional restraint system typically includes an adjustment mechanism for tightening and loosening the straps. In conventional restraint systems, the straps, fastening mechanism and adjustment mechanism are in close proximity to and accessible by the child seated in the highchair. Such proximity to the child often makes them a primary target for dropped food, spilled liquids and/or and the child's messy hands. As a result, the restraint system is almost always soiled when the highchair is in use.

The connection between the straps and the fastening and adjustment mechanisms in conventional systems generally has many nooks, gaps, and crevices that give food and other messy substances a place to lodge. As a result, they are relatively difficult to clean. Indeed, the food and liquid are sometimes permanently absorbed into the fibers or material from which the restraint straps are formed, or packed into the fastening and/or adjustment mechanisms. Thus, the cleanliness and/or functional performance of the restraint system may be adversely affected. Moreover, because the adjustment mechanisms of conventional restraint systems are within reach of the seating area, they could possibly be subject to being undesirably handled by the seated child or infant.

Accordingly, there is a need for an infant support structure having a restraint assembly that is easily adjustable, and/or that is not accessible to a seated child or infant, and/or that eliminates or minimizes the absorption of food, liquid and other debris, and/or that is easily cleaned.

SUMMARY OF THE INVENTION

The present invention relates to an infant support structure including a support frame, a seat portion coupled to the support frame and configured for receiving an infant, and a restraint assembly. The restraint assembly is coupled to the seat portion and configured to retain the infant in the seat portion. The restraint assembly includes a strap portion having a polymer coating.

In one embodiment, the strap portion is substantially encased by the polymer coating. In one implementation, the polymer coating is a urethane coating. In one implementation, the strap portion is selected from the group consisting of fabric tape, polypropylene webbing, and nylon webbing.

In one embodiment, the strap portion includes a first portion fused to a second portion to form a looped portion. The looped portion extends through a fastener so that the fastener is coupled to the strap portion. In one implementation, the polymer coating disposed over the first portion is cross-linked to the polymer coating disposed over the second portion to define a welded area.

The present invention also relates to an infant support structure including a support frame, a seat portion coupled to the support frame, and a restraining strap. The seat portion includes a front portion defining a receiving area configured for retaining an infant and an opposite back portion, and an opening extending between the front portion and the back portion. The restraining strap includes a first portion coupled to the front portion, an opposite second portion adjacent the back portion, and a central portion extending through and slidable within the opening so that a length of the first portion is adjustable. The second portion of the restraining strap is releasably securable to the back portion to selectively maintain the length of the first portion.

In one embodiment, the support structure also includes a securing or clamping mechanism coupled to the back portion of the seat portion. The second portion of the restraining strap is releasably securable to the back portion via the clamping mechanism. In one implementation, the clamping mechanism is a cam buckle. In some embodiments, the clamping mechanism is pivotally coupled to the back portion. In other embodiment, the clamping mechanism is fixedly coupled to the back portion.

In an alternative embodiment, the securing mechanism includes a post coupled to the back portion. The second portion of the restraining strap includes a plurality of holes. The post is extendable through a selected one of the holes to releasably secure the second portion to the back portion.

In one embodiment, the seat portion includes a backrest. The opening extends through the backrest. The second portion of the restraining strap is releasably securable to an exterior surface of the backrest.

In one embodiment, the restraining strap is comprised of a webbing member having a polymer coating. In one implementation, the webbing member is substantially encased by the polymer coating, such as a urethane coating.

The present invention also relates to an infant support structure including an infant receiving portion and a strap portion. The strap portion is coupled to the infant receiving portion and configured to restrain an infant in the infant receiving portion. The strap portion has a polymer coating. In one implementation, the strap portion is urethane coated webbing.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

The terms "infant support structure" and "support structure" may be used interchangeably herein, and refer to a structure that can be used to support and/or retain a child or infant, such as for example, but not limited to, a swing, a bouncer, an infant seat, and a high chair.

Figure 1:
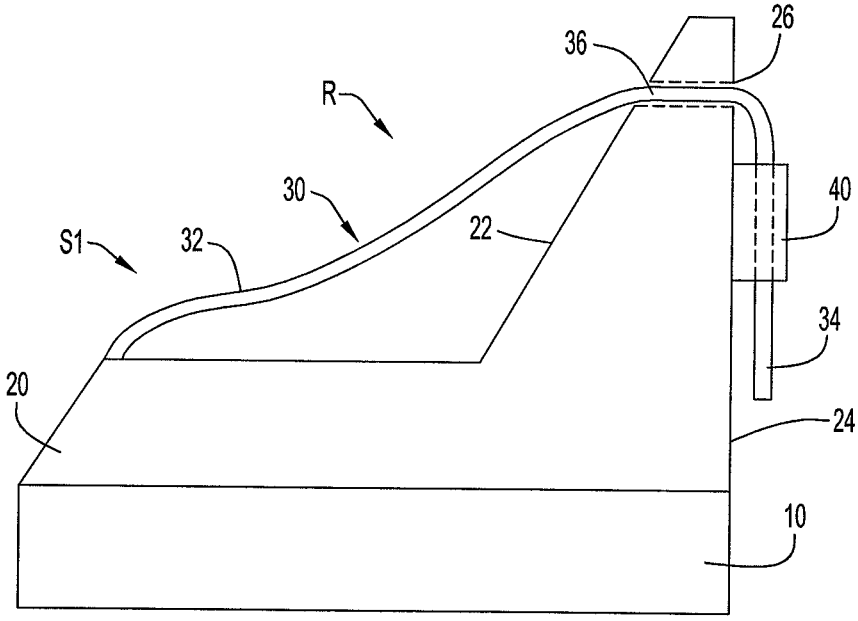
FIG. 1 illustrates a schematic diagram of an infant support structure according to an embodiment of the present invention.

FIG. 1 illustrates a schematic diagram of an infant support structure S1 according to an embodiment of the present invention. Support structure S1 includes a support frame 10, a seat portion 20 coupled to the support frame 10 and configured for receiving an infant, and a strap portion 30 coupled to the seat portion 20 and configured to retain the infant in the seat portion 20.

The specific configuration of the support frame 10 and/or the seat portion 20 may vary. For example, the support frame 10 and the seat portion 20 may be configured as a highchair having a seat and support frame similar to that disclosed and illustrated in U.S. Pat. No. 7,578,561 to Canna et al., the disclosure of which is incorporated herein in its entirety by reference. Alternatively, the support frame 10 and the seat portion 20 may be configured as a swing, a child booster seat, or another infant or child support structure.

The seat portion 20 includes a front portion 22 defining a receiving area R configured for retaining an infant and an opposite back portion 24. An opening 26 extends between the front portion 22 and the back portion 24. The strap portion 30 includes an end portion 32 coupled to the front portion 22, another opposite end portion 34 adjacent the back portion 24, and a central portion 36. The central portion 36 extends through and is slidable within the opening 26, so that the end portion 32 of the strap portion 30 that is disposed in the receiving area R has an adjustable length. The other end portion 34 is releasably securable to the back portion 24 of the seat portion 20, thereby maintaining a selected length of the end portion 32 in the receiving area R. In this way, the strap portion 30 may be tightened or loosened within the receiving area R, such as to comfortably restrain a child or an infant within the seat portion 20.

In one embodiment, a clamping mechanism 40 is coupled to the back portion 24 of the seat portion 20. The end portion 34 of the strap portion 30 is releasably securable to the back portion 24 via the clamping mechanism 40. For example, the clamping mechanism 40 may be a cam buckle, with a portion of the end portion 34 extending therethrough (shown in phantom).

Figure 2:
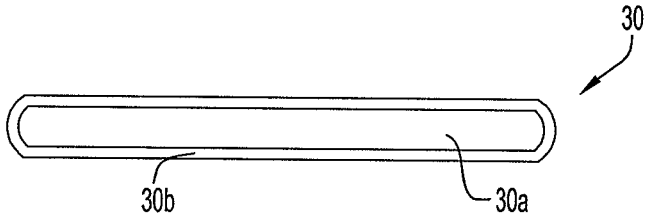
FIG. 2 illustrates a sectional view of a strap portion according to an embodiment of the present invention and usable with the disclosed infant support structures.

Referring to FIG. 2, in one embodiment, the strap portion 30 includes a webbing member 30*a* having a polymer coating 30*b*. The webbing member 30*a* may be a fabric tape or a synthetic webbing material, such as polypropylene webbing or nylon webbing. In one embodiment, the webbing member 30*a* is substantially encased by the polymer coating 30*b*. In one implementation, the strap portion 30 is urethane coated webbing.

Figure 3:
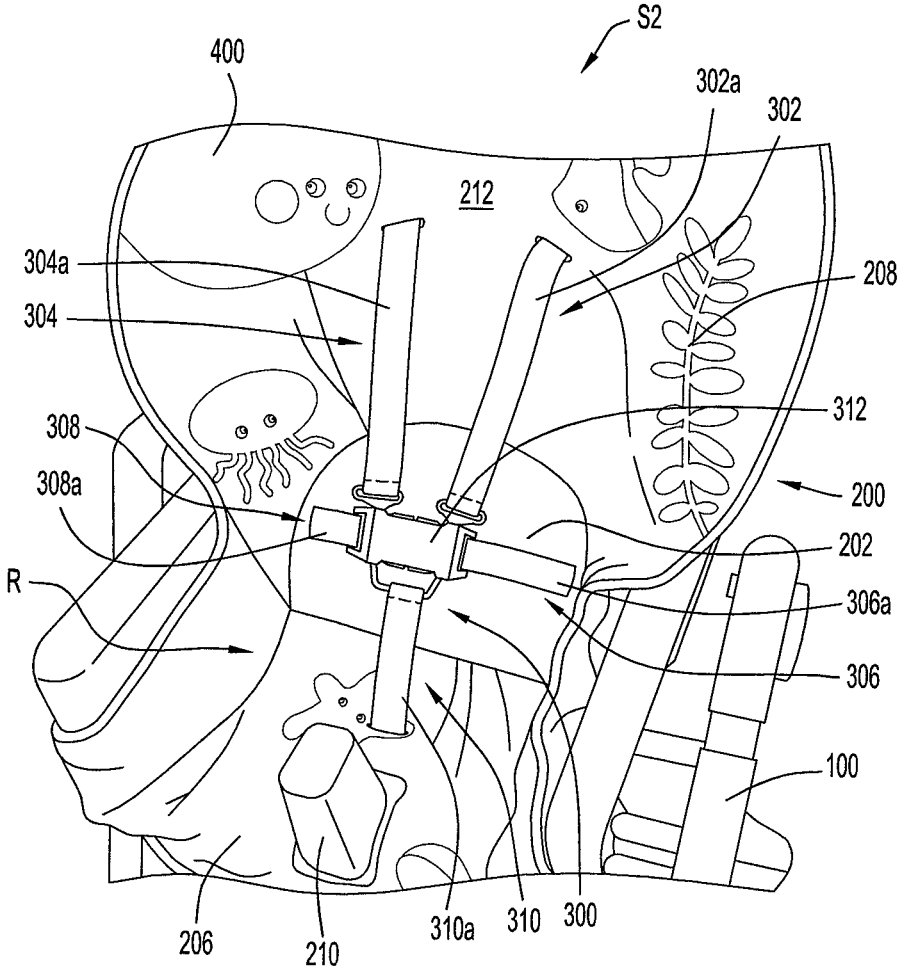
FIG. 3 illustrates a front perspective fragmentary view of an infant support structure according to another embodiment of the present invention.
Figure 4:
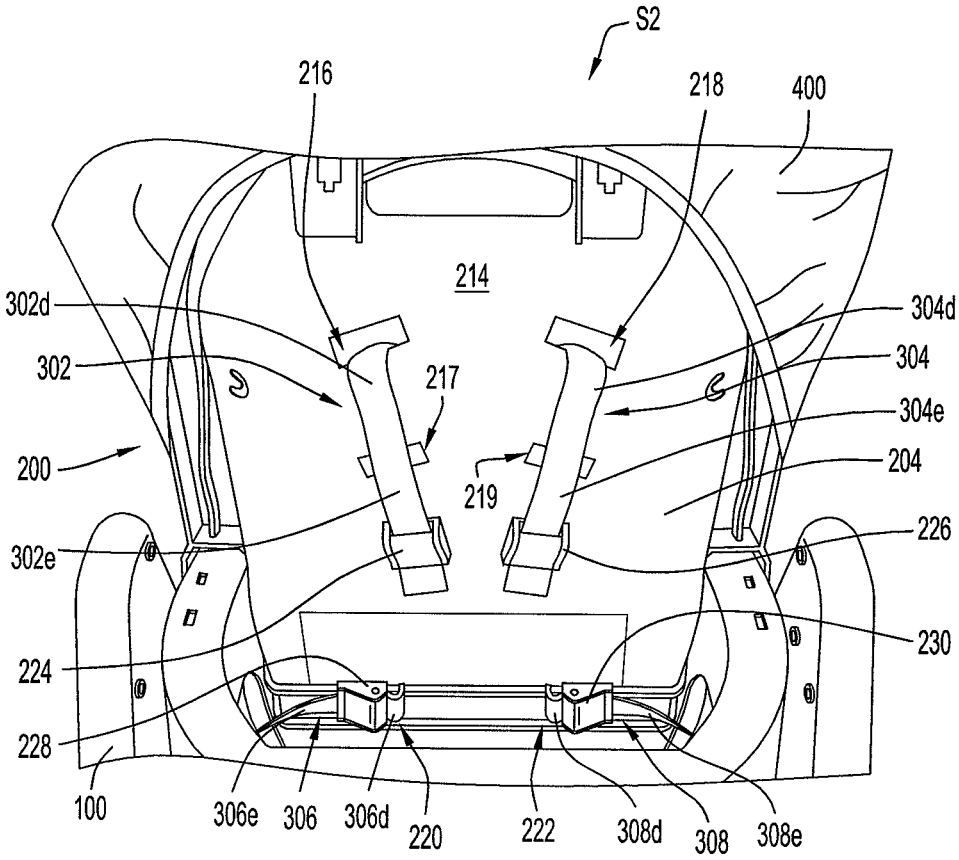
FIG. 4 illustrates a rear perspective fragmentary view of the infant support structure of FIG. 3.

FIGS. 3 and 4 illustrate perspective fragmentary views of an infant support structure S2 according to another embodiment. Support structure S2 includes a support frame 100 and a seat portion 200 coupled to the support frame 100. The seat portion 200 includes a front portion 202 defining a receiving area R configured for retaining an infant, and an opposite back portion 204. A restraint assembly 300 is coupled to the seat portion 200 and configured to retain the infant within the receiving area R.

In one embodiment, the seat portion 200 includes a seat bottom 206 and a seat back 208 coupled to the seat bottom 206. In one embodiment, the seat back 208 is pivotally coupled to the seat bottom 206, and may be retained at a selected incline position such as described in U.S. Pat. No. 7,578,561. The seat bottom 206 includes a crotch post 210 to aid in retaining the infant in the receiving area R. The seat back 208 includes an interior surface 212 adjacent to the receiving area R that partially defines the front portion 202 of the seat portion 200, and an opposite exterior surface 214 that partially defines the back portion 204 of the seat portion 200.

As shown in FIG. 4, a pair of upper passages 216, 218 extend through the seat back 208 and between the front portion 202 and the back portion 204. Another pair of lower passages 220, 222 extends through the seat back 208 (or the seat bottom 206) and between the front portion 202 and the back portion 204.

Referring again to FIGS. 3 and 4, in one embodiment, a seat pad 400 is provided that is releasably coupleable to the seat portion 200 and within the receiving area R. The seat pad 400 may be made from any type of soft, durable, cushion material that is safe, readily cleanable, and comfortable to a child's touch. The seat pad 400 includes passages alignable with the passages associated with the restraint assembly 300 (described in detail below).

Referring to FIG. 3, the restraint assembly 300 includes a left shoulder strap 302, a right shoulder strap 304, a left waist strap 306, a right waist strap 308, and a crotch strap 310. Each of the straps 302, 304, 306, 308, 310 includes an end 302*a*, 304*a*, 306*a*, 308*a*, 310*a*, respectively, disposed in the receiving area R. The ends end 302*a*, 304*a*, 306*a*, 308*a*, 310*a* are coupled together at a central point in the receiving area R by a center connector 312.

In one embodiment, the straps 302, 304, 306, 308, 310 of the restraint assembly 300 are polymer coated webbing, such as described above and as shown in FIG. 2. For example, straps 302, 304, 306, 308 and/or 310 may be polypropylene or nylon webbing partially or substantially encased by a polymer coating, such as a urethane coating.

Figure 5:
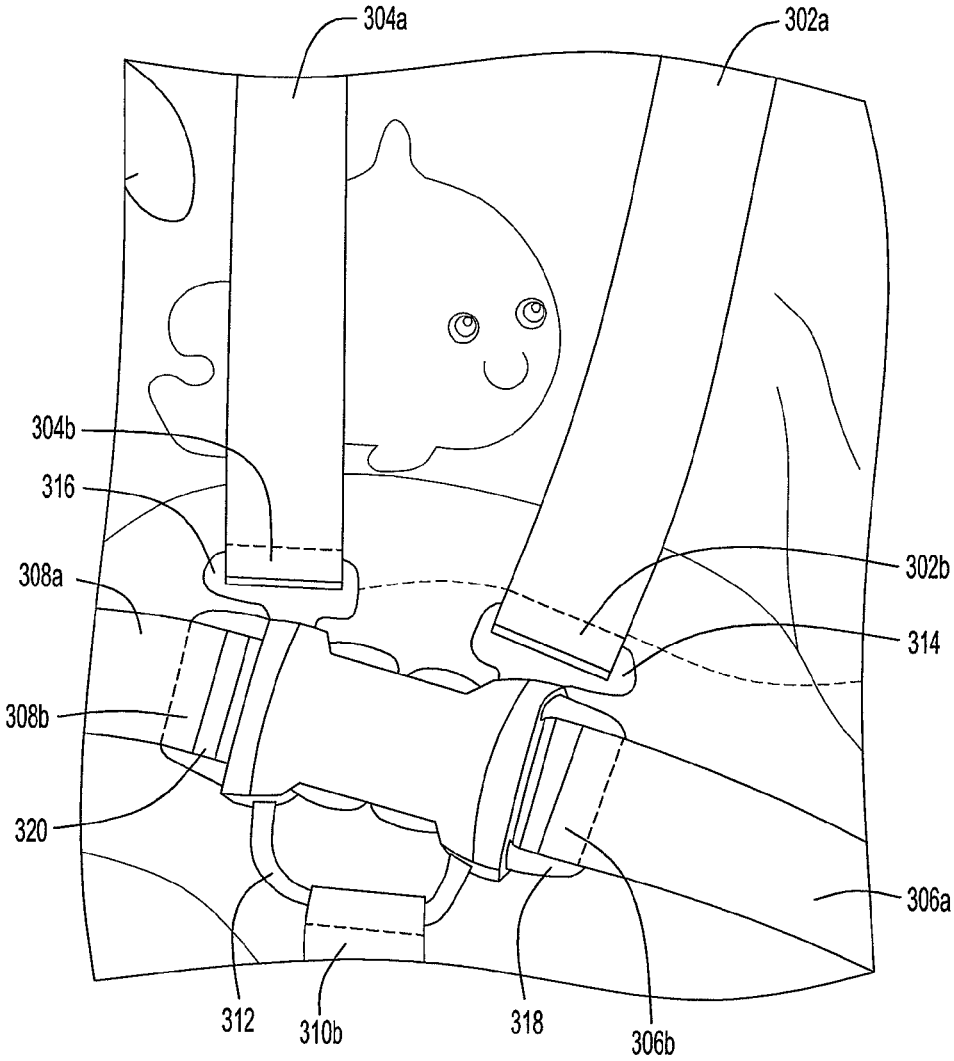
FIG. 5 illustrates an exploded perspective view of portions of a restraint assembly disposed in an infant receiving area of the infant support structure of FIG. 3.

Referring to FIG. 5, each of the ends 302*a*, 304*a*, 306*a*, 308*a*, 310*a* of the straps 302, 304, 306, 308, 310, respectively, is coupled to the center connector 312.

In one embodiment, end 302*a* of the left shoulder strap 302 forms a loop 302*b* through which an associated portion of a fastener 314 extends. For example, a portion of end 302*a* may be folded over and attached to another portion of end 302*a* to form loop 302*b*. Similarly, end 304*a* of the right shoulder strap 304 forms a loop 304*b* through which another fastener 316 is attached. End 306*a* of the left waist strap 306 forms a loop 306*b* through which another fastener 318 is attached. End 308*a* of the right waist strap 308 forms a loop 308*b* through which another fastener 320 is attached. End 310*a* of the crotch strap 310 forms a loop 310*b* through which a portion of the center connector 312 is attached.

Fasteners 316, 318, 320, 322 are releasably securable to the center connector 312. Thus, the shoulder straps 302, 304 and the waist straps 306, 308 may be releasably secured to the crotch strap 310 via fasteners 316, 318, 320, 322 and the center connector 312 to form a five-point harness for securely retaining an infant or child within the receiving area R.

In one embodiment, one or more of the loops 302*b*, 304*b*, 306*b*, 308*b*, 310*b* are formed by sewing the corresponding folded portions of ends 302*a*, 304*a*, 306*a*, 308*a*, 310*a* together. In an alternative embodiment, one or more of the loops 302*b*, 304*b*, 306*b*, 308*b*, 310*b* are formed by fusing the corresponding folded portions of the ends 302*a*, 304*a*, 306*a*, 308*a*, 310*a* together.

Figure 6:
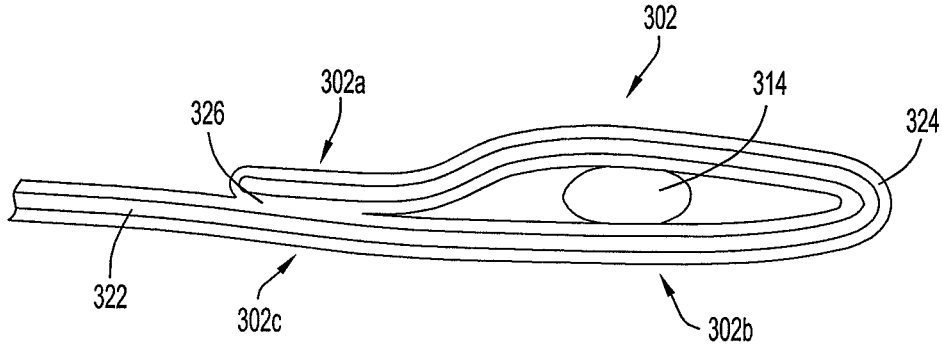
FIG. 6 illustrates a sectional view of a portion of a strap of the restraint assembly of the infant support structure of FIG. 3.

Referring to FIG. 6, in one implementation, the end 302*a* of the strap 302 is fused to a proximate portion 302*c* thereof to form the loop 302*b*. The strap 302 includes a webbing 322 (e.g. polypropylene or nylon webbing) encased by a polymer coating 324 (e.g. a urethane coating). The polymer coating 324 disposed over the end 302*a* is cross-linked to the corresponding polymer coating 324 disposed over the portion 302*c*, such as by the application of heat and pressure, to define a bonded or welded area 326. One or more of the loops 304*b*, 306*b*, 308*b*, 310*b* of the other straps 304, 306, 308, 310 may be formed via a similar fusing or welding operation.

Because the polymer coating 324 is fused together, the resulting welded area 326 is free from any seams or gaps. Thus, the resulting connection between the strap 302 and its associated fastener 314 minimizes or eliminates the possibility of absorption of food, liquids and/or other debris into the fused area. In addition, branding, such as company or product logos, may be easily impressed into the polymer coating 324 during the welding or fusing operation.

Referring again to FIG. 4, the left shoulder strap 302 includes a central portion 302*d* extending through the upper passage 216 and an end portion 302*e* adjacent to the back portion 204. The right shoulder strap 304 includes a central portion 304*d* extending through the other upper passage 218 and an end portion 304*e* adjacent to the back portion 204. The left waist strap 306 includes a central portion 306*d* extending through the lower passage 220 and an end portion 306*e* adjacent to the back portion 204. The right waist strap 308 includes a central portion 308*d* extending through the other lower passage 222 and an end portion 308*e* adjacent to the back portion 204.

Thus, each one of the central portions 302*e*, 304*e*, 306*e*, 308*e* of the corresponding straps 302, 304, 306, 308 is slidably disposed within a corresponding one of the passages 216, 218, 220, 222, respectively. In this way, the lengths of the portions of the straps 302, 304, 306, 308 disposed within the receiving area R (shown in FIG. 3) may be adjusted by moving the end portions 302*e*, 304*e*, 306*e*, 308*e* toward or away from their corresponding passages 216, 218, 220, 222.

In one embodiment, a pair of intermediate passages 217, 219 extend through the seat back and between the front portion 202 and the back portion 204. The intermediate passages 217, 219 are aligned with and spaced below the upper passages 216, 218. The left and right shoulder straps 302, 304 may be selectively inserted through either the upper passages 216, 218 or the intermediate passages 217, 219. Thus, the height of the shoulder straps 302, 304 relative to the shoulders of a child seated in the receiving area R may be adjusted.

The end portions 302*e*, 304*e*, 306*e*, 308*e* may be releasably secured to the back portion 204 of the seat portion 200 via clamping mechanisms so that the lengths of the portions of the straps 302, 304, 306, 308 disposed in the receiving area R may be selectively maintained. Thus, the clamping mechanisms for adjusting and maintaining the lengths of the straps 302, 304, 306, 308 are not accessible to an infant or child seated within the receiving area R. As such, they may not be adjusted or handled by an infant or child seated in the receiving area R.

Moreover, the clamping mechanisms are not likely to be contaminated by spilled food and liquids. Thus, cleaning the restraint assembly 300 is relatively easy. The ease with which the restraint assembly 300, and thus the support structure S2, may be cleaned is further enhanced via the implementation of the polymer coated straps or webbing, and/or via the use of fasteners secured to the straps via welding or fusing, as described above.

With continued reference to FIG. 4, in one embodiment, a plurality of cam buckles 224, 226, 228, 230 are coupled to the back portion 204 of the seat portion 200. Cam buckles 224, 226 are attached to the exterior surface 214 of the seat back 208, and positioned for receiving the corresponding end portions 302*e*, 304*e* of the left and right shoulder straps 302, 304, respectively.

Figure 7:
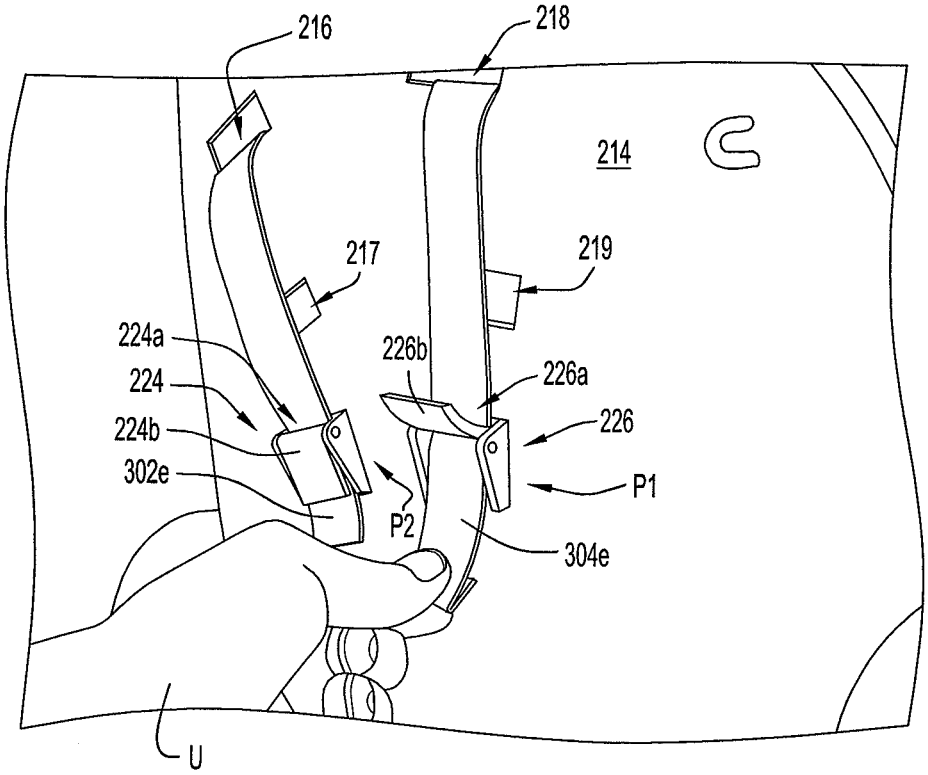
FIG. 7 illustrates another rear perspective fragmentary view of the infant support structure of FIG. 3 and showing a retaining mechanism according to one embodiment of the present invention.

Referring to FIG. 7, the cam buckles 224, 226 includes slots 224*a*, 226*a* through which the end portions 302*e*, 304*e* are fed, and levers 224*b*, 226*b* movable between an unlocked or open position P1 and a locked or closed position P2 by a user U. With the levers 224*b*, 226*b* in their open positions P1, the end portions 302*e*, 304*e* may be pulled or moved downwardly in the slots 224*a*, 226*a* and away from the cam buckles 224, 226, thereby reducing the lengths of the corresponding end portions 302*a*, 304*a* of the straps 302, 304 disposed in the receiving area R.

Alternatively, the end portions 302*e*, 304*e* may be moved upwardly through the slots 224*a*, 226*a* and toward their corresponding passages 216, 218, so that the lengths of the corresponding end portions 302*a*, 304*a* of the straps 302, 304 disposed in the receiving area R may be increased. Once the desired length of each of the shoulder straps 302, 304 in the receiving area R is obtained, the levers 224*b*, 226*b* may be pivoted to their closed positions P2, thereby releasably securing the straps 302, 304 within the cam buckles 224, 226 and maintaining the selected lengths of the end portions 302*a*, 304*a*.

Referring again to FIG. 4, cam buckles 228, 230 are attached to the exterior surface 214 of the seat back 208, and positioned for receiving the corresponding end portions 306*e*, 308*e* of the left and right waist straps 306, 308, respectively. The desired length of each of the waist straps 306, 308 disposed within the receiving area R may be selected and releasably maintained via cam buckles 228, 230 in a similar manner as described above.

In one embodiment, the cam buckles 224, 226, 228, 230 are fixedly coupled to the exterior surface 214 of the seat back 208 (and/or another location on the back portion 204 of the seat portion 200), so that their corresponding slots (e.g. slots 224*a*, 226*a*) remain in a fixed position relative to the exterior surface 214 of the seat back 208.

In an alternative embodiment, one or more of the cam buckles 224, 226, 228 230 are rotatably coupled to exterior surface 214 of the seat back 208 (and/or another location on the back portion 204 of the seat portion 204), so that their corresponding slots (e.g. slots 224*a*, 226*a*) are movable or rotatable relative to the exterior surface 214 of the seat back 208. Such pivotal movement of the cam buckles 224, 226, 228, 230 relative to the exterior surface 214 allows the end portions 302*e*, 304*e*, 306*e*, 308*e* of the corresponding straps 302, 304, 306, 308 to be easily aligned with and threaded through the corresponding slots (e.g. slots 224*a*, 226*a*) in the cam buckles 224, 226, 228, 230.

It should be understood that other mechanisms for releasably securing the end portions 302*e*, 304*e*, 306*e*, 308*e* to the back portion 204 of the seat portion 200 may be employed. For example, other buckles, clamps, clips, or the like may be provided on the back portion 204, which cooperate with the straps 302, 304, 306, 308 so that the lengths of the portions of the straps 302, 304, 306, 308 disposed within the receiving area R may be selectively maintained.

Figure 8:
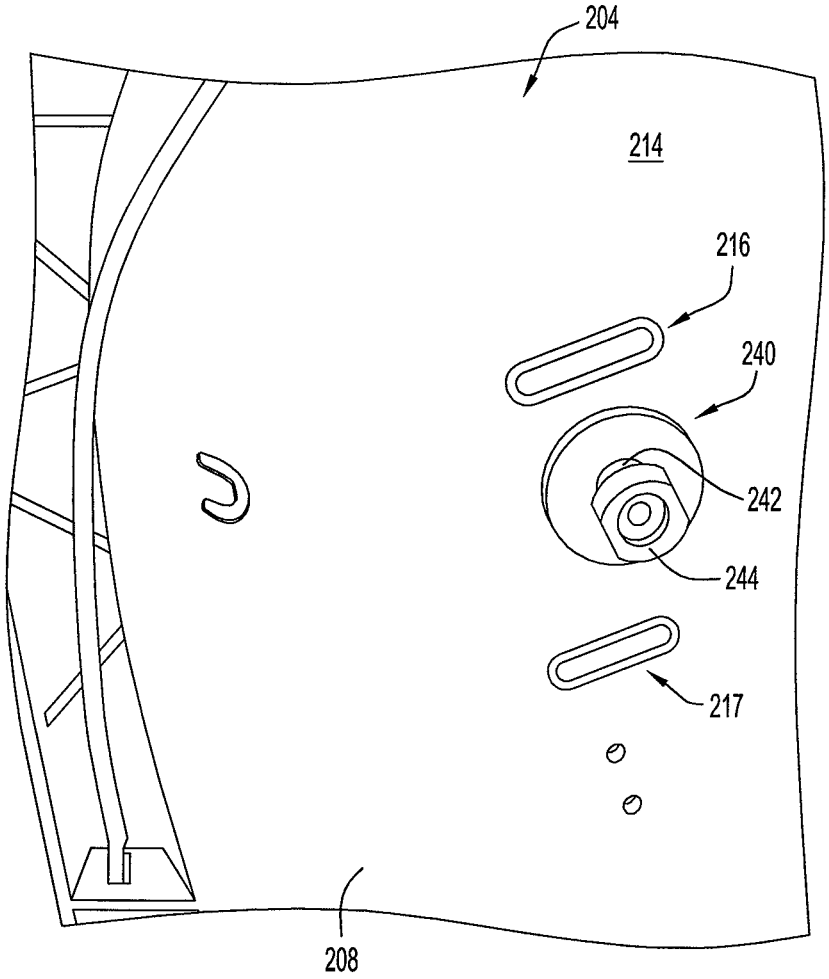
FIG. 8 illustrates another rear perspective fragmentary view of the infant support structure of FIG. 3 and showing a retaining mechanism according to another embodiment of the present invention.

Referring to FIG. 8, a retaining mechanism 240 according to another embodiment for releasably securing the corresponding portions of straps to the back portion 204 of the seat portion 200 is illustrated. The retaining mechanism 240 includes a post 242 extending outwardly from the exterior surface 214 of the seat back 208. A flanged end 244 is coupled to a distal end of the post 242. The flanged end 244 has a diameter greater than the diameter of the post 242.

Figure 9:
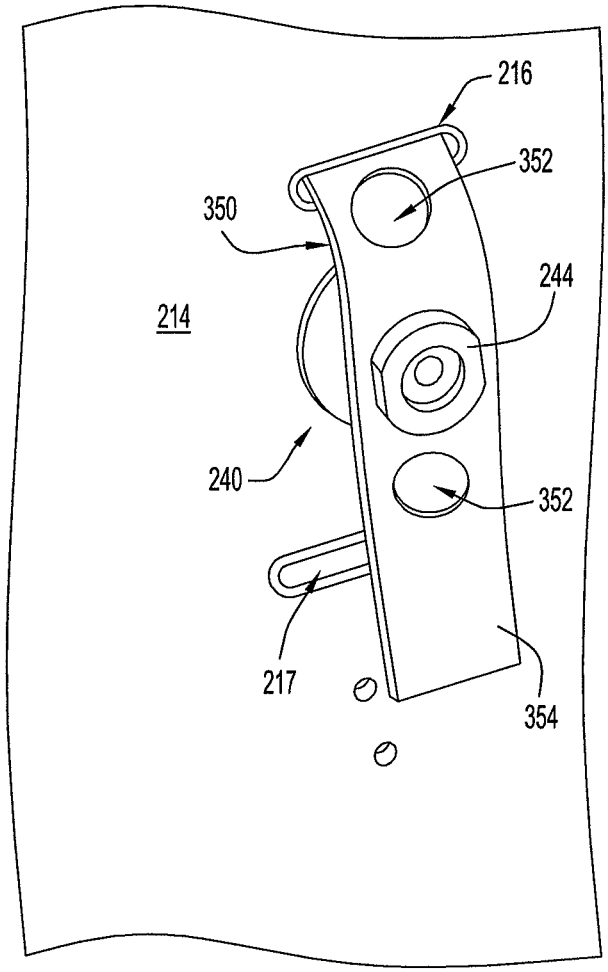
FIG. 9 illustrates another rear perspective fragmentary view of the infant support structure of FIG. 3 and showing the retaining mechanism of FIG. 8 cooperating with a strap according to another embodiment of the present invention.

Referring to FIG. 9, the retaining mechanism 240 is configured to cooperate with a strap 350 having a plurality of spaced holes 352 disposed in an end portion 354 thereof. The retaining mechanism 240 is aligned with the corresponding passage 216 (or 217, 218, 219, 220, 222) in the seat back 208, so that a selected one of the holes 352 may be aligned with the post 242 as the strap 350 is pulled through the corresponding passage 216 (e.g. to tighten or loosen the corresponding portion of the strap 350 disposed in the receiving area R).

In one embodiment, the holes 352 have a diameter slightly smaller than the diameter of the flanged end 244. When a selected hole 352 is aligned with the post 242, the strap 350 may be pulled downwardly (or upwardly if the strap 350 extends through the intermediate passage 217) and over the flanged end 244. The selected hole 352 is thereby deformed slightly until it is moved past the flanged end 244, and the strap 350 is seated around the post 242. The strap 350 is thereby releasably retained on the post 242.

Aside from the plurality of holes 352, in one embodiment the configuration and construction of the strap 350 is identical to the straps (e.g. 302, 304, 306, 308) described above. Accordingly, the material from which the strap 350 is formed permits deformation of the holes 352 when being secured to or released from the post 242.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant support structure, comprising:

a support frame;

a seat portion coupled to the support frame, the seat portion configured for receiving an infant in a seated position;

a restraint assembly coupled to the seat portion and configured to retain the infant in the seat portion, the restraint assembly including a strap portion having a polymer coating, the polymer coating being a urethane coating.

2. The infant support structure of claim 1, wherein the strap portion is substantially encased by the polymer coating.

3. The infant support structure of claim 2, wherein the strap portion includes a first portion fused to a second portion to form a looped portion, the looped portion extending through a fastener so that the fastener is coupled to the strap portion.

4. The infant support structure of claim 3, wherein the polymer coating disposed over the first portion is cross-linked to the polymer coating disposed over the second portion to define a welded area.

5. The infant support structure of claim 1, wherein the strap portion is selected from the group consisting of fabric tape, polypropylene webbing, and nylon webbing.

6. The infant support structure of claim 1, wherein the strap portion includes a plurality of webbing members for retaining the infant in the seat portion.

7. An infant support structure, comprising:

a support frame;

a seat portion coupled to the support frame, the seat portion including a front portion defining a receiving area configured for retaining an infant in a seated position and an opposite back portion, and an opening extending between the front portion and the back portion;

a restraining strap having a polymer coating that includes a webbing member, the webbing member being substantially encased by the polymer coating, and the restraining strap including a first portion coupled to the front portion, an opposite second portion adjacent the back portion, and a central portion extending through and slidable within the opening so that a length of the first portion is adjustable, the second portion releasably securable to the back portion to selectively maintain the length of the first portion.

8. The infant support structure of claim 7, further comprising a clamping mechanism coupled to the back portion, the second portion of the restraining strap releasably securable to the back portion via the clamping mechanism.

9. The infant support structure of claim 8, wherein the clamping mechanism is a cam buckle.

10. The infant support structure of claim 8, wherein the clamping mechanism is pivotally coupled to the back portion.

11. The infant support structure of claim 7, further comprising a post coupled to the back portion, the second portion of the restraining strap including a plurality of holes, the post extendable through a selected one of the holes to releasably secure the second portion to the back portion.

12. The infant support structure of claim 7, wherein the seat portion includes a backrest, the opening extending through the backrest, and the second portion of the restraining strap releasably securable to a back portion of the backrest.

13. The infant support structure of claim 7, wherein the polymer coating is a urethane coating.

14. The infant support structure of claim 7, wherein a distal end of the restraining strap is fused to the first portion thereof to form a looped portion, the looped portion extending through a fastener coupled to the front portion of the seat portion.

15. The infant support structure of claim 14, wherein the polymer coating disposed over the distal end is cross-linked to the polymer coating disposed over the first portion to define a welded area.

16. An infant support structure, comprising:

an infant receiving portion;

a strap portion coupled to the infant receiving portion and configured to restrain an infant in a seated position within the infant receiving portion, the strap portion being a urethane coated webbing.

* * * * *